US005425818A

United States Patent [19]

Hirosawa et al.

[11] Patent Number: 5,425,818

[45] Date of Patent: Jun. 20, 1995

[54] RARE EARTH-IRON-NITROGEN SYSTEM PERMANENT MAGNET AND PROCESS FOR PRODUCING THE SAME

[75] Inventors: Satoshi Hirosawa, Ootsu; Takashi Ikegami, Ibaragi; Ken Makita, Osaka; Tsutomu Mashimo, Kumamoto, all of Japan

[73] Assignee: Sumitomo Special Metals Co., Ltd., Osaka, Japan

[21] Appl. No.: 158,564

[22] Filed: Nov. 29, 1993

[30] Foreign Application Priority Data

Nov. 27, 1992 [JP] Japan ..... 4-341620

[51] Int. Cl.[6] ..... H01F 1/059

[52] U.S. Cl. ..... 148/103; 148/101; 148/104; 264/84; 419/66

[58] Field of Search ..... 148/101, 103, 104; 264/84; 419/66

[56] References Cited

U.S. PATENT DOCUMENTS 4,925,501 5/1990 Harasek ..... 148/101
5,137,887 8/1992 Schultz et al. ..... 148/103
5,137,888 8/1992 Wecker et al. ..... 148/103

FOREIGN PATENT DOCUMENTS 2-257663 2/1990 Japan .
4-368102 12/1992 Japan ..... 148/103

OTHER PUBLICATIONS

Coey et al., "Improved Magnetic Properties By Treatment of Iron-Based Rare Earth Intermetallic Compounds in Ammonia," in *Journal of Magnetism and Magnetic Materials*, 87 (1990) L251–L254.

*Primary Examiner*—John P. Sheehan
*Attorney, Agent, or Firm*—Watson, Cole, Grindle & Watson

[57] ABSTRACT

A densified high performance rare earth-iron-nitrogen permanent magnet obtained from a powder of a $Th_2Zn_{17}$ compound containing nitrogen at interlattice sites, without using autogeneous sintering and yet preventing decomposition and/or denitrification from occurring. The process for producing the same need not necessarily use a binder, and it comprises compaction molding, or charging while applying a magnetic field, a powder of a nitrogen intrusion T—R—N compound having a specified composition and a $Th_2Zn_{17}$ crystal structure, and applying thereto shock compression at a drive pressure of from 10 to 25 GPa as reduced to an equivalent drive pressure in an iron capsule.

20 Claims, 3 Drawing Sheets

RARE EARTH-IRON-NITROGEN SYSTEM PERMANENT MAGNET AND PROCESS FOR PRODUCING THE SAME

BACKGROUND OF THE INVENTION

1. Industrial Field of Application

The present invention relates to a rare earth-iron-nitrogen permanent magnet comprising a interstitially nitrogen compound having a $Th_2Zn_{17}$ crystal structure. The present invention also relates to a rare earth-iron-nitrogen magnet obtained by compression molding a powder of the compound having a specified composition, and densifying the molding to obtain a high density bulk magnet by applying shock compression to the resulting molding to prevent decomposition or denitrification from occurring. The present invention further relates to a process for producing the same.

2. Prior Art

Conventionally known high performance magnets are based on rare earth elements include samarium-cobalt (Sm—Co) magnets and neodymium-iron-boron (Nd—Fe—B) magnets. The former type magnets have excellent thermal stability and corrosion resistance, whereas the latter type magnets, which can be produced from low cost starting materials, have extremely high magnetic properties. Hence, both types of magnets are widely used at present.

However, rare earth magnets having further improved thermal stability and high magnetic properties and yet reduced in material cost are still desired from applications such as actuators of electric and electronic parts of motor cars as well as of various types of factory automation machines, and magnets of rotators.

A novel magnet material which satisfy the above demands has been reported recently by J. M. D. Coey and H. Sun, *J. Magn. Magn. Mater.*, 87 (1990) L251, and in JP-A-2-57663 (the term "JP-A-" as referred herein signifies "an unexamined published Japanese patent application"). The disclosed process comprises producing a fine powder of an iron-rare earth compound having a $Th_2Zn_{17}$ crystal structure and allowing the fine powder to react with $N_2$ gas, a mixed gas of $NH_3$ and $H_2$, etc., at a relatively low temperature in the range of from 400° to 600° C. In this manner, a $Th_2Zn_{17}$ type compound containing N atoms intruded into interlattice sites and thereby yielding considerably improved Curie temperature and magnetic anisotropy can be obtained. The compound is thus considered promising as a novel magnet material satisfying the above needs, and its practical use is expected.

The aforementioned $Th_2Zn_{17}$ type compound (referred to as "2-17 system R—Fe—N compound" hereinafter) containing nitrogen atoms in interlattice sites is obtained only as a powder, and it decomposes under an ordinary pressure into α-Fe and a rare earth nitride at temperatures not lower than about 600° C. It is therefore impossible to obtain a bulk magnet by an ordinary industrial process based on autogeneous sintering based on a diffusion mechanism.

Accordingly, the use of the compound as a bonded magnet using a resin or a low melting metal has been studied. This application, however, has limits in increasing the content of the 2-17 system R—Fe—N compound powder. That is, from the viewpoint of life of the mold and the like, the maximum allowable content of the 2-17 system R—Fe—N compound powder is about 80% by volume. The 2-17 system R—Fe—N compound in the resulting bonded magnet then fails to fully exhibit its superiority in magnetic properties, and falls far behind the conventional Sm—Co system or Nd—Fe—B system magnets concerning the magnetic characteristics. Moreover, the superior magnetic properties and thermal stability of the 2-17 system R—Fe—N compound cannot be fully recognized because of the poor heat resistance of the binder.

An object of the present invention is to provide a densified high performance rare earth-iron-nitrogen permanent magnet from a 2-17 system R—Fe—N compound powder by a process not based on autogeneous sintering, and from which a binder can be omitted. Another object of the present invention is to provide a process for producing the same.

SUMMARY OF THE INVENTION

The present inventors have found that a solidified bulk magnet based on metallic bonds and having a high apparent density accounting for 90% of the true density or even higher can be easily obtained by a process comprising: producing in advance, a powder compact having a density accounting for 40% or more but less than 90% of the true density from a 2-17 system R—Fe—N compound powder of a specified composition; and subjecting the resulting powder compact to impact compression under an impact pressure equivalent to a drive pressure in an iron capsule of from 10 GPa to 25 GPa to take advantages of the impact compression process, which is a short time phenomenon, is capable of exerting very-high shear stress, has an activating function, etc., thereby controlling the residual temperature after the impact compression inside the compact to a temperature not higher than the decomposition temperature (about 600° C. under an ordinary pressure). The present invention has been completed based on these findings.

The present invention provides a rare earth-iron-nitrogen permanent magnet containing a phase having a $Th_2Zn_{17}$ type crystal structure as the principal phase, comprising a composition expressed by a compositional formula $T_{100-x-y}R_xN_y$, wherein T represents Fe or Fe containing 20% or less of at least one selected from the group consisting of Co and Cr as a partial substituent thereof; R represents at least one selected from the group consisting of rare earth elements inclusive of Y, provided that Sm accounts for 50 atm. % or more; and x and y each represent percents by atomic with x being in the range of from 9 to 12 and y being in the range of from 10 to 16, and having an apparent density accounting for 90% or more of the true density.

The present invention also provides a process for producing a rare earth-iron-nitrogen system permanent magnet, comprising:

Compression molding, into a powder compact having an apparent density accounting for 40 to 90% of the true density, a powder of an interstitially nitrogenated T—R—N compound having a $Th_2Zn_{17}$ type crystal structure and comprising a composition expressed by a compositional formula $T_{100-x-y}R_xN_y$, wherein T represents Fe or Fe containing 20% or less of at least one selected from the group consisting of Co and Cr as a partial substituent thereof; R represents at least one selected from the group consisting of rare earth elements inclusive of Y, provided that Sm accounts for 50% or more; and x and y each represent percents by atomic with x being in the range of from 9 to 12 and y being in the range of from 10 to 16; and charging said powder compact into a capsule and applying impact compression at a pressure equivalent to a drive force in an iron capsule of from 10 GPa to 25 GPa, thereby obtaining a solidified bulk magnet based on metallic bonds and having an apparent density accounting for 90% or higher of the true density.

The present invention further provides a process for producing a rare earth-iron-nitrogen permanent magnet in the same constitution as above, provided that the compression molding is performed in a magnetic field to impart anisotropy to the molding.

The present invention furthermore relates to a process for producing a bulk rare earth-iron-nitrogen permanent magnet having an apparent density accounting for 90% or more of the true density, by charging the powder of the nitrogen-intrusion type T—R—N compound having a $Th_2Zn_{17}$ type crystal structure and the composition above into a capsule at a charge density of from 40 to 70%, and while applying a magnetic field in a pulsed mode to impart grain orientation, subjecting the powder under a drive pressure equivalent to that in an iron capsule of from 10 GPa to 25 GPa.

DETAILED DESCRIPTION OF THE INVENTION

Figure 1:
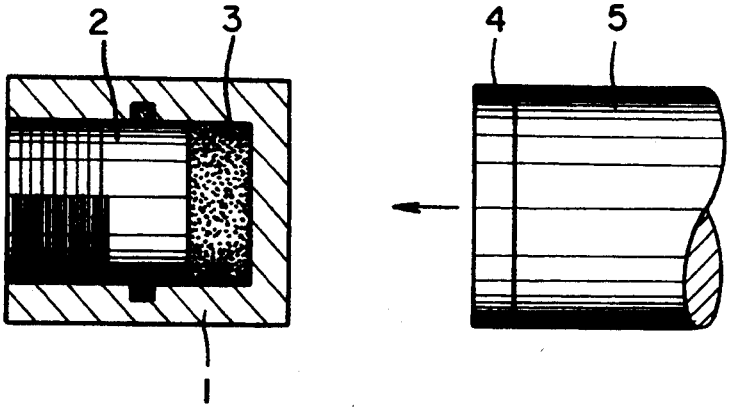
FIG. 1 is a schematically drawn explanatory figure to show an embodiment of collision type of shock compression process.

It is essential in the present invention that a powder of an $R_2T_{17}$ compound having a $Th_2Zn_{17}$ type is used as the alloy powder before and after nitriding. To satisfy this requirement, the content of R (a rare earth metal) of the powder must be in the range of from 9 to 12% by atomic.

If the content of R should be less than 9% by atomic, $\alpha$-Fe would precipitate, and if it should be in excess of 12% by atomic, unfavorable $RFe_3$ and the like may form mixed with the desired bulk magnet to impair the magnetic properties of the product.

R includes at least one selected from the group consisting of rare earth elements inclusive of Y, but it must contain 50 atm. % or more Sm to achieve a desired coercive force. An Sm content of less than 50 atm. % is unfavorable. If Sm should account for only less than 50 atm. % of the entire R, the magnetic anisotropy of the $R_2T_{17}$ compound after nitriding would be considerably lowered as to make the exhibition of the desired coercive force difficult.

T represents a transition metal containing Fe as the principal component. It should be limited, however, to Fe alone or Fe containing 20% or less of at least one selected from the group consisting of Co and Cr as a substituent for Fe from the viewpoint of material cost and magnetic properties obtainable after nitriding, particularly magnetic anisotropy of the crystal.

Cobalt (Co) and chromium (Cr) stabilizes the 2-17 type crystal structure and is favorable for improving the corrosion resistance. However, Co or Cr incorporated as a substituent at an amount exceeding 20% is not preferred, because the material cost would be increased thereby and the magnetization would be lowered.

Nitrogen (N) is an essential element for the magnet according to the present invention. The magnetization and the magnetic anisotropy, particularly Curie temperature, clearly depend on the concentration of nitrogen. If nitrogen were to be added at an amount less than 10% by atomic, a sufficiently magnetic anisotropy to achieve a desired coercive force would not be obtained, and if it were to be added over 16% by atomic, the magnetic anisotropy would be reversely reduced to lower the coercive force. Accordingly, nitrogen is most preferably added at an amount of from 12.8% to 13.8% by atomic.

The powder of the nitrogen intrusion type T—R—N compound having the $Th_2Zn_{17}$ crystal structure to be used in the present invention can be prepared by melting T (a transition metal) and R (a rare earth metal) in a vacuum melting furnace or by preparing a powder according to a reduction diffusion process which comprises heating a mixture of T, $R_2O_3$, and Ca under vacuum or in an Ar atmosphere and reacting the resulting compound with $N_2$ or $NH_3$ gas, or in a mixed gas of $NH_3$ and $H_2$ at a temperature in the range of from 300° to 600° C. for a duration of from 10 minutes to 36 hours.

The bulk solidification step using impact compression method according to the present invention takes advantage of the very-high shear stress and the activating function of the shock wave to induce solidification based on metallic bonds and fine division of the structure. In this manner, a solidified bulk with high coercive force is implemented. At the same time, the bulk accompanies an average temperature rise due to increase in entropy based on volume contraction and the nonlinear phenomenon of the shock wave. However, the temperature rise settles within an extremely short time interval of several microseconds or even less, and it does not induce any decomposition and denitrification.

However, residual temperature remains in the powder compact for a substantial period of time after compression a residual temperature equal to or higher than the decomposition temperature of the T—R—N compound (about 600° C. under an ordinary pressure) is not preferred, because the decomposition of the $Th_2Zn_{17}$ type T—R—N compound would initiate to from $\alpha$-Fe and deteriorates the magnetic properties of the product.

It is effective to increase the charge density of the powder to facilitate the suppression of temperature rise in the powder. Accordingly, it is preferred to prepare a powder compact by compression molding the powder to increase the density thereof as high as possible before subjecting it to impact compression. A powder compact having an apparent density accounting for 40 to 90% of the true density can be obtained, however, by subjecting the powder to an ordinary pressing under a pressure of from 1 to 8 ton/cm$^2$.

Furthermore, the axes of easy magnetization of the powder grains can be oriented along one direction by effecting the compression molding under a magnetic field. The powder compact thus obtained can be solidified into a bulk while maintaining the one direction oriented grains by subjecting the powder compact to shock compression. In this matter, a bulk magnet having a uniaxial anisotropic magnetization can be obtained.

Furthermore, anisotropy can be imparted to the powder compact by applying a synchronized magnetic field in pulses to the powder upon shock to orient easy direction of magnetization of the powder. However, this method is not effective to a powder charged at too high a density, because the movement of the powder grains inside a too highly charged compact would be limited to prevent the grains from being oriented. Accordingly, the powder must be charged at a density of 70% or lower.

To generate a shock wave to apply an impact pressure to a solid, a collision method or a direct method using explosives may be used. The former process can be further classified into two according to what to use in accelerating a shock plate. One comprises using a gun, and the other, an explosive. The better method is also classified into two, one is cylindrically conversing wave method and the other is plane wave method.

In the collision method, the pressure which generates inside the solid upon propagation of a shock wave depends on the velocity of the flyer plate and on the shock impedance (initial density times the phase velocity of the shock wave) of the capsule, the sample, and the flyer plate. In the direct method using an explosive, an explosive is set into a direct contact with the drive plate, or the capsule, or the sample to directly transfer the detonation wave. The drive pressure depends on the performance of the explosives, principally the detonation velocity and density, and the impact impedance of the drive plate or the capsule and the sample which are in contact with the explosive.

The shock impedance depends on a material-dependent state variable called the Hugoniot which is the relation between the shock velocity and the particle velocity of the material. The pressure which generates inside the sample greatly differs depending on the shock impedance even though a same shock plate and flyer velocity or an explosive are used. In particular, the shock impedance for a powder sample containing pores is considerably lower than that for a bulk sample. Accordingly, the generated pressure also decreases with increasing porosity of the sample. On the other hand, the change in volume increases to thereby increase the temperature rise.

The Hugoniot parameters for most of the powder samples is unknown. It is possible to calculate the Hugoniot function for a powder from that for a sample of true density, and then obtain the pressure inside the powder sample. However, the calculated value according to this method accompanies great discrepancy from the actual value due to temperature effects.

It ca be seen therefrom that the intensity of a shock wave cannot be properly expressed by the pressure inside the sample. Thus, the pressure which generates in the capsule which collides directly with a flyer plate or which is brought into direct contact with the explosives is taken as an intensity of the shock wave (drive pressure).

The capsule is generally made of a sufficiently hard and tough material such as soft steel, stainless steel, and brass and aluminum, so that the sample inside the capsule could not be scattered by capsule breakage upon receiving an impact.

The drive pressure used in the present invention is not so high. Brass and aluminum may be used for the capsule, however, considering that a low-cost soft steel (iron) is a more generally use industrial material, the pressure which generates in an iron capsule is taken as a standard for the drive pressure. Accodingly, the drive pressure is expressed by reducing it to an equivalent drive presure in an iron capsule.

In using a material other than iron, the measured Hugoniot function for the material is compared with that for iron to determine the impact conditions from the drive pressure reduced to that for an iron capsule, according to the impedance matching method.

For an industrial production using shock compression, in general, the use of explosives is more advantageous as compared with a gun method. When a relatively weak impact wave as in the case of the present invention is used, a relatively low power explosive having a density of from about 1 to 1.5 g/cm$^3$ and an explosion speed of about 5,000 km/s or lower, such as a dynamite, a slurry explosive, an ammonium nitrate fuel oil explosive (ANFO), and a Papex can be used for both the direct method and the collision method.

In performing the present invention, the drive pressure on shock compression must be controlled to a pedetermined value to suppress temperature rise of the powder compact.

A powder compact of the 2-17 type R—T—N compound powder and having a density of from 40 to 90% by a conventional process must be subjected to a drive pressure of lower than 25 GPa as reduced to a drive pressure for an iron capsule according to the present invention. The application of a controlled drive pressure suppresses the decomposition of the above compound with the rise of temperature which occurs upon application of a shock compression. In the case when the density of the powder compact is high ( 60%), the preterable drive pressure is below 19 GPa as reduced to an equivalent drive pressure in iron. If too low a drive pressure should be applied to the powder compact, insufficient solidification occurs to the powder compact and a bulk magnet having a density of 90% or higher would not be obtained. This signifies that the impact pressure must be higher than 10 GPa as reduced to an equivalent drive pressure for an iron capsule. Accordingly, the pressure applied to the powder compact must be in the range of from 10 GPa to 25 GPa as reduced to an equivalent drive pressure for an iron capsule. The base magnetic performance is usually obtained more preferably by applying a drive pressure of from 10 GPa to 19 GPa as reduced to an equivalent pressure for an iron capsule system magnetically oriented powder compact of density of 60% or higher of the true density.

In the present invention, the shock compression process comprises densification and/or synthesis of a powder at high efficiency by propagating a shock wave to the powder material. The shock compression process can be further classified into two, i.e. a direct method which comprises placing a necessary amount of explosives around the outside of a capsule charged with a starting power material, and allowing the detonation wave generated by the explosion of the explosives to be propagated to the starting material through the planer or the cylindrical capsule, and a collision method which comprises propagating a shock wave to a starting material by placing a planer or a cylindrical capsule charged with a starting material inside a reaction vessel, and accelerating a metal piece or a cylindrical tube to a high velocity using a detonation wave generated from a compressed gas or an explosion or combustion of explosives or a combustion gas and colliding it against the sample capsule. Those methods require, according to the installation and equipment, proper choice of the performance and the amount of explosives, and control of the size and material of the flyer plate and the drive plate so that an impact compression at an impact pressure in the range of from 10 GPa to 25 GPa as reduced to the drive pressure for an iron capsule can be maintained.

The present invention is characterized by compression molding a powder of a nitrogen-intrusion type T—R—N compound having a $Th_2Zn_{17}$ type crystal structure and comprising a specified composition into a powder compact having an apparent density accounting for from 40 to 90% of the true density and charging said powder compact into a capsule, or without subjecting the powder to compression molding but charging the powder into a capsule to a charge density of from 40 to 70%, which is to be aligned simultaneously on shock compression by applying a magnetic field in pulses and applying impact compression to the charged powder at a pressure as reduced to an equivalent drive force inside an iron capsule of from 10 GPa to 25 GPa. Briefly, the present invention is characterized by taking advantages such as very-high pressure, short-time phenomenon, high strain rate, shear force, and activating function of impact compression to solidify the powder into a bulk based on metallic bonds and to finely divide the structure to achieve bulk solidification and high coercive force at the same time, while allowing compaction without using autogeneous sintering within a short period of time. In this matter, it is also possible to prevent decomposition or denitrification from occurring and obtain a densified high performance rare earth-iron-nitrogen system permanent magnet; moreover, a binder not necessarily be used in the process.

However, the rear earth-iron-nitroge system permanent magnet may be produced by using a binder. In this case the binder may be formed by addition of less than 15% by weight of a powder of Al, Cu, Zn, In or Sn.

The present invention is illustrated in greater detail referring to non-limiting examples below. It should be understood, however, that the present invention is not to be construed as being limited thereto.

EXAMPLE 1

Referring to FIG. 1, each of the four types of powder 3 composed of particles from 4 to 5 μm in average diameter and whose composition is given in table 1 was subjected to powder compaction under a pressure of 1.5 ton/cm$^2$ while applying a 2 magnetic field of about 10 kOe to obtain a grain-oriented powder compact. The resulting powder compact was charged into a brass capsule (1) and fixed therein using a brass plug (2).

The capsule (1) thus obtained was fixed inside a reaction vessel, and a flyer plate (5) comprising a 3 mm thick aluminum sheet (4) adhered thereto was accelerated by a combustion gas generated from an propellant powder to allow the flyer plate to impact against the capsule (1). In this manner, a shock wave was generated inside the capsule (1), and the drive pressure applied to the brass capsule by the primary wave of the shock wave was calculated according to the impedance matching method using the Hugoniot curves for the flyer plate and the capsule, and the impact velocity. The results are given in Table 1. The samples were recovered by a momentum trap method.

In Table 1 is also given a reduced equivalent drive pressure in terms of a primary wave applied to an iron capsule by colliding the same aluminum flyer plate against the capsule at the same velocity.

Subsequent to the impact compression, the solidified sample (3) was taken out from the capsule (1), magnetized under a pulsed magnetic field of 70 kOe, and subjected to a magnetic measurement using a VSM. The results are given in Table 1. Density was also measured and given in Table 1.

Figure 2:
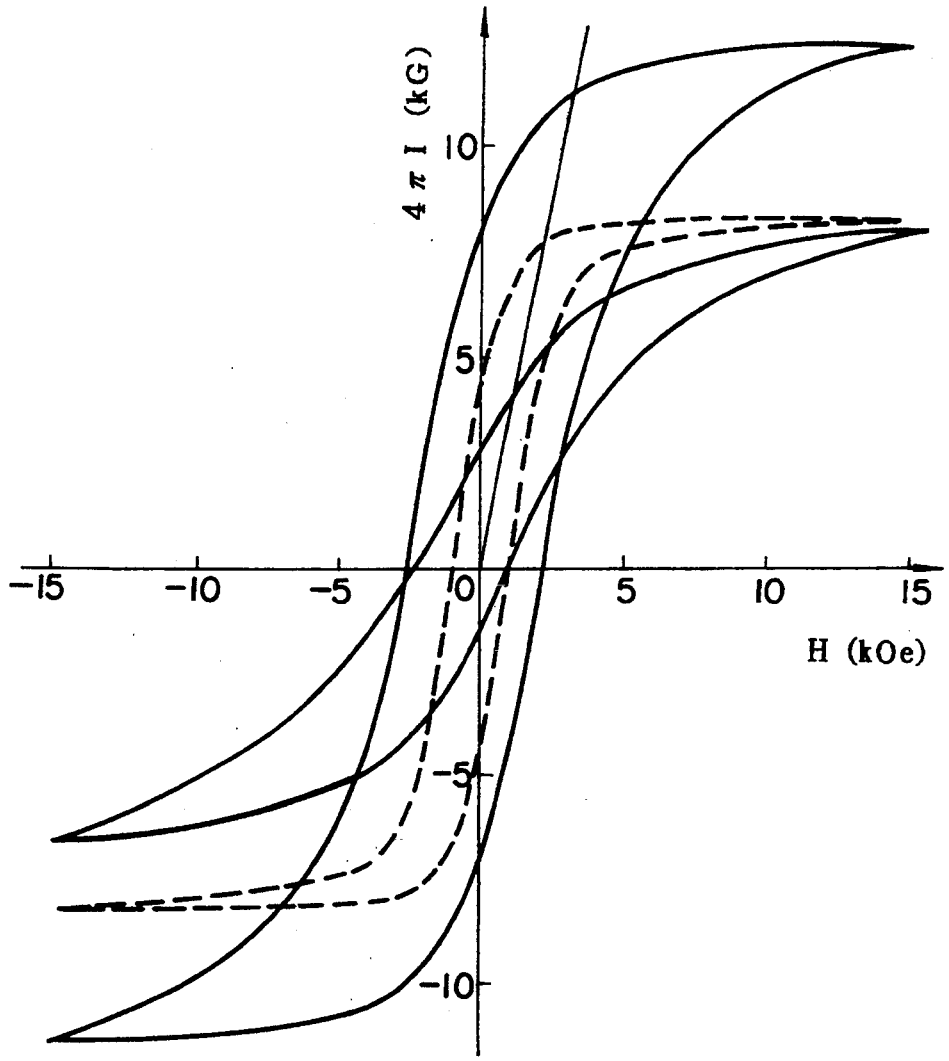
FIG. 2 is a graph showing demagnetization curves for each of the cases in which the measurement is performed along a direction in parallel with the grain orientation of the powder compact, and in which the measurement is performed along a direction vertical to the grain orientation; in the figure, broken lines show the demagnetization curve for a powder compact having a compact density of 60%, and solid lines show that for an impact compressed magnet according to an embodiment (Example 2) of the present invention.
Figure 3:
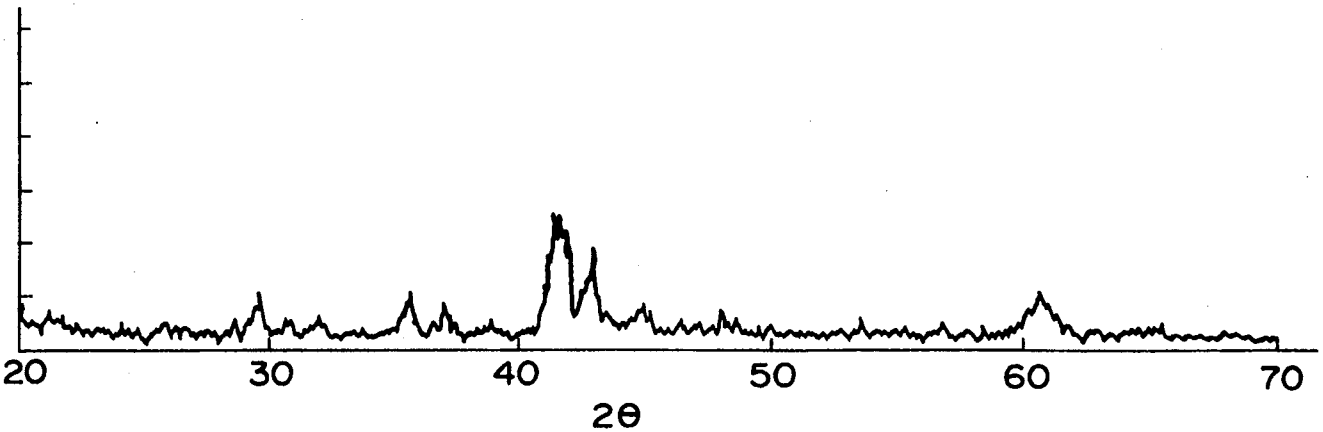
FIG. 3 provides an X-ray diffractogram which identifies the magnet obtained according to another embodiment (Example 1) of the present invention as a compound having a $Th_2Zn_{17}$ type crystal structure.

FIG. 2 shows demagnetization curves obtained for a direction in parallel with the grain orientation of the powder compact and for a direction vertical to the grain orientation. In the figure, broken lines show the demagnetization curves for the powder compact. It can be seen that the shock compression not only increases the density but also the coercive force of the compact. X-ray diffraction revealed that the solidified magnets all have the $Th_2Zn_{17}$ type crystal structure. FIG. 3 shows the results obtained by X-ray diffraction.

Comparative Example 1

The powder having he compositon No. 1 as shown in Table 1 and composed of grains 4 μm in average diameter was molded into a powder compact in the same manner as in Example 1. The powder compact was subjected to impact compression using flyer plate comprising a 3 mm thick aluminum sheet, a iron capsule, and a brass plug. The plate was allowed to fly at a velocity of 1,270 km/s to generate a pressure of 25.6 GPa inside the capsule. The other conditions Were the same as those employed in Example 1. The magnetic properties and the density of the resulting powder compact were measured in the same manner as in Example 1 to give the results shown in Table 1.

X-ray diffraction for the sample obtained in Comparative Example 1 revealed generation of SmN and a considerable amount of α-Fe after impact compression, thereby indicating decomposition of the starting Sm—Fe—N compound.

EXAMPLE 2

A powder compact was obtained in the same manner as in Comparative Example 1, and was subjected to impact compression using a fly plate comprising a 2 mm thick copper sheet, an iron capsule, and an iron plug. The plate was allowed to fly at a velocity of 1,435 km/s to generate a pressure of 29.9 GPa inside the capsule. The other conditions were the same as those employed in Example 1. The magnetic properties and the density of the resulting powder compact were measured in the same manner as in Example 1 to give the results shown in Table 1.

X-ray diffraction for the sample obtained in Comparative Example 1 revealed generation of SmN and a considerable amount of α-Fe after impact compression, thereby indicating decomposition of the starting Sm—Fe—N compound.

TABLE 1

| Ex. No. | Material[1)] 1 | Material[1)] 2 | Composition (% atomic) | Powder compact density prior to shock compression ($g/cm^3$) | Flyer Velocity (km/s) | Drive Pressure (GPa) |
|---|---|---|---|---|---|---|
| 1 | Al | Brass | $Sm_{9.2}Fe_{77.4}N_{13.4}$ | 4.1 | 1.102 | 13.0 |
| 2 | Al | Brass | $Sm_{9.2}Fe_{77.4}N_{13.4}$ | 4.1 | 1.300 | 15.8 |
| 3 | Al | Brass | $Sm_{9.2}Fe_{67.4}Co_{10.0}N_{13.4}$ | 4.1 | 1.300 | 15.8 |
| 4 | Al | Brass | $Sm_{9.2}Fe_{75.4}Cr_{2.0}N_{13.4}$ | 4.1 | 1.300 | 15.8 |
| 5 | Al | Brass | $Sm_{9.2}Fe_{67.4}Co_{8.0}Cr_{2.0}N_{13.4}$ | 4.1 | 1.300 | 15.8 |
| Comp. 1 | Al | Iron | $Sm_{9.2}Fe_{77.4}N_{13.4}$ | 4.1 | 1.557 | 25.6 |
| Comp. 2 | Cu | Iron | $Sm_{9.2}Fe_{77.4}N_{13.4}$ | 4.1 | 1.435 | 29.9 |

| Ex. No. | Equivalent reduced pressure calculated for an iron capsule (GPa) | Magnetic Properties $4\pi Is$ (kG) | Br (kG) | iHc (kOe) | Density after shock compression Absolute ($g/cm^3$) | Relative (%) | Crystal structure of Principal Phase after Compression |
|---|---|---|---|---|---|---|---|
| 1 | 12.7 | 12.1 | 10.7 | 2.5 | 7.13 | 95 | $Th_2Zn_{17}$ |
| 2 | 15.4 | 12.3 | 11.2 | 2.6 | 7.20 | 96 | $Th_2Zn_{17}$ |
| 3 | 15.4 | 11.8 | 10.8 | 2.3 | 7.28 | 96 | $Th_2Zn_{17}$ |
| 4 | 15.4 | 11.6 | 10.7 | 2.6 | 7.18 | 96 | $Th_2Zn_{17}$ |
| 5 | 15.4 | 11.7 | 10.7 | 2.4 | 7.23 | 96 | $Th_2Zn_{17}$ |
| Comp. 1 | 25.6 | 11.2 | 9.0 | 0.6 | 7.28 | 97 | α-Fe(bcc) |
| Comp. 2 | 29.9 | 11.3 | 7.0 | 0.2 | 7.28 | 97 | α-Fe(bcc) |

*[1)]1: Flyer plate; 2: Capsule

EXAMPLE 3

A powder having the composition No. 3 as shown in Table 1 and composed of grains 4 μm in average diameter was molded into a cylindrical powder compact of a density of 4.0 $g/cm^3$, 16 mm in diameter and 8 mm in height using a mechanical pressing machine equipped with a cam. No magnetic field was applied to the pressing machine during the molding. The powder compact thus obtained was placed inside a brass capsule 16.5 mm in inner diameter and fixed therein using a brass plug. A shock wave was generated in the same manner as in Example 1 using an apparatus having an explosive gun. The generated pressure was controlled to be the same as that for the sample No. 2 in Example 1. After impact compression, the solidified sample was taken out from the capsule and cut into cubes about 2 mm in size, magnetized using a 70-kOe pulsed magnetic field, and subjected to a measurement using a VSM. The magnetic properties after correction for reversed magnetic field are given in Table 2 below.

TABLE 2

| Density ($g/cm^3$) | Magnetic Properties $4\pi I_{15}$ (kG) | Br (kG) | iHc (kOe) |
|---|---|---|---|
| 7.26 | 5.6 | 4.8 | 2.5 |

where, $4\pi I_{15}$ represents magnetization under an external magnetic field of 15 kOe.

X-ray diffraction after impact compression confirmed the sample to have a $Th_2Zn_{17}$ crystal structure.

EXAMPLE 4

A powder having the composition No. 1 as shown in Table 1 and composed of grains 4 μm in average diameter was charged inside a cylindrical cavity of brass 12 mm in diameter and 6 mm in depth at an apparent density of 3.4 $g/cm^3$, and fixed with a brass plug. A coreless solenoid was placed inside a reaction vessel, and the brass capsule was fixed inside the solenoid using a brass plug to effect impact compression under the same conditions for sample No. 2 of Example 1. During the compression, a pulsed magnetic field was applied to the sample using a trigger signal synchronized with the ignition signal of the impact gun, so that a current may be provided to the coreless coil from the capacitor bank 50 μs before the ignition. A preliminary test revealed that a magnetic field about 20 kOe is generated inside the cavity of the brass capsule, at a rise time of about 30 μs and a pulse half width of about 60 μs.

EXAMPLE 5

The same powder as that used in Example 3 was charged and fixed inside a brass capsule at an apparent density of 3.4 $g/cm^3$ in the similar manner as in Example 3. A 24-kOe pulsed magnetic field generated externally using a coreless coild was applied to the capsule, and the resulting capsule was fixed inside a reaction vessel for shock compression under the same conditions as those used for sample No. 2 in Example 1.

The properties after impact compression of the samples obtained in Examples 3 and 4 are listed in Table 3 below.

TABLE 3

| Nos. | Density ($g/cm^3$) | Magnetic Properties $4\pi I_{15}$ (kG) | Br (kG) | iHc (kOe) |
|---|---|---|---|---|
| 3 | 7.13 | 12.0 | 10.6 | 2.2 |
| 4 | 7.13 | 12.1 | 10.7 | 2.4 |

As described in the foregoing, the present invention provides a densified high performance rare earth-iron-nitrogen system permanent magnet without using autogeneous sintering and yet preventing decomposition or denitrification from occurring. The process for producing the same need not necessarily use a binder, and it comprises compaction molding with or without applying an external magnetic field to orient the powder, a powder of a nitrogen intrusion type T—R—N compound having a specified composition and a $Th_2Zn_{17}$ type crystal structure, and applying thereto shock compression with or without coincidentially applying a pulsed magnetic field on the powder.

While the invention has been described in detail and with reference to specific embodiments thereof, it will be apparent to one skilled in the art that various changes and modifications can be made therein without departing from the spirit and scope thereof.

What is claimed is:

1. A process for producing a permanent magnet comprising a rare earth, iron and nitrogen, comprising:

compression molding, into a powder compact having an apparent density accounting for 40 to 90% of the true density, a powder of an interstitially nitrogenated T—R—N compound having a $Th_2Zn_{17}$ crystal structure and comprising a composition expressed by a compositional formula $T_{100-x-y}R_xN_y$, wherein T represents Fe or Fe containing 20% or less of at least one selected from the group consisting of Co and Cr as a partial substituent thereof; R represents at least one selected from the group consisting of rare earth elements inclusive of Y, provided that Sm accounts for 50 atm. % or more; and x and y each represent percents by atomic with x being in the range of from 9 to 12 and y being in the range of from 10 to 16; and charging said powder compact into a capsule and applying shock compression at a pressure as reduced to an equivalent drive force in an iron capsule of from 10 GPa to 25 GPa, thereby obtaining a solidified bulk magnet having an apparent density accounting for 90% or higher of the true density.

2. A process for producing a rare earth-iron-nitrogen permanent magnet as claimed in claim 1, wherein the equivalent drive pressure in an iron capsule is in the range of from 10 GPa to 19 GPa.

3. A process for producing a rare earth-iron-nitrogen parmanent magnet as claimed in claim 1, wherein compression molding of the powder is performed under a magnetic field to impart anisotropy to the powder compact.

4. A process for producing a rare earth-iron-nitrogen permanent magnet as claimed in claim 1, wherein y is in the range of from 12.8% by atomic to 13.8% by atomic.

5. A process for producing a rare earth-iron-nitrogen permanent magnet as claimed in claim 1, wherein y is in the range of from 12.8% by atomic to 13.8% by atomic.

6. A process for producing a rare earth-iron-nitrogen permanent magnet as claimed in claim 1, wherein a powder of the interstitially nitrogenated T—R—N compound having the $Th_2Zn_{17}$ crystal structure is prepared by either melting a transition metal T and a rare earth metal R in a vacuum melting furnace or by preparing a powder according to a reduction diffusion process which comprises heating a mixture of T, $R_2O_3$, and Ca under vacuum or in an Ar atmosphere, followed by reacting the resulting compound with $N_2$ or $NH_3$ gas, or in a mixed gas of $NH_3$ and $H_2$ at a temperature in the range of from 300° to 600° C. for a duration of from 10 minutes to 36 hours.

7. A process for producing a rare earth-iron-nitrogen permanent magnet as claimed in claim 2, wherein a powder of the interstitially nitrogenated T—R—N compound having the $Th_2Zn_{17}$ crystal structure is prepared by either melting a transition metal T and a rare earth metal R in a vacuum melting furnace or by preparing a powder according to a reduction diffusin process which comprises heating a mixture of T, $R_2O_3$, and Ca under vacuum or in an Ar atmosphere, followed by reacting the resulting compound with $N_2$ or $NH_3$ gas, or in a mixed gas of $NH_3$ and $H_2$ at a temperature in the range of from 300° to 600° C. for a duration of from 10 minutes to 36 hours.

8. A process for producing a rare earth-iron-nitrogen prmanent magnet as claimed in claim 1, wherein compression molding of the powder is performed by applying a molding pressure in the range of from 1 to 8 ton/cm$^2$.

9. A process for producing a rare earth-iron-nitrogen permanent magnet as claimed in claim 2, wherein compression molding of the powder is performed by applying a molding pressure in the range of from 1 to 8 ton/cm$^2$.

10. A process for producing a rare earth-iron-nitrogen permanent magnet as claimed in claim 1, wherein a capsule made from soft steel or stainless steel, or brass or aluminum is used.

11. A process for producing a rare earth-iron-nitrogen permanent magnet as claimed in claim 1, wherein the shock wave in performing shock compression is generated by either collision method or direct method using explosives.

12. A process for producing a rare earth-iron-nitrogen permanent magnet as claimed in claim 2, wherein the shock wave in performing shock compression is generated by either collision method or direct method using explosives.

13. A process for producing a rare earth-iron-nitrogen permanent magnet as claimed in claim 1, wherein a powder of one element selected from the group consisting of Al, Cu, Zn, ID and Sn is further added as a binder.

14. A process for producing a rare earth-iron-nitrogen permanent magnet, comprising:

charging into a capsule, at a charge density of from 40 to 70%, a powder of the interstitially nitrogenated T—R—N compound having a $Th_2Zn_{17}$ crystal structure and comprising a composition expressed by a compositional formula $T_{100-x-y}R_xN_y$, wherein T represents Fe or Fe containing 20% or less of at least one selected from the group consisting of Co and Cr as a partial substituent there of; R represents at least one selected from the group consisting of rare earth elements inclusive of Y, provided that Sm accounts for 50 atm. % or more; and x and y each represent percents by atomic with x being in the range of from 9 to 12 and y being in the range of from 10 to 16; and while applying a magnetic field in a pulsed mode to impart grain orientation to the powder, subjecting the powder Under a drive pressure as reduced to an equivalent pressure in an iron capsule of from 10 GPa to 19 GPa, thereby obtaining a solidified bulk magnet having an apparent density accounting or 90% or higher of the true density.

15. A process for producing a rare earth-iron-nitrogen permanent magnet as claimed in claim 14, wherein y is in the range of from 12.8% by atomic to 13.8% by atomic.

16. A process for producing a rare earth-iron-nitrogen prmanent magnet as claimed in claim 14, wherein a powder of the interstitially nitrogenated T—R—N compound having the $Th_2Zn_{17}$ crystal structure is prepared by either melting a transition metal T and a rare earth metal R in a vacuum melting furnace or by preparing a powder according to a reduction diffusion process which comprises heating a mixture of T, $R_2O_3$, and Ca under vacuum or in an Ar atmosphere, followed by reacting the resulting compound with $N_2$ or $NH_3$ gas, or in a mixed gas of $NH_3$ and $H_2$ at a temperature in the range of from 300° to 600° C. for a duration of from 10 minutes to 36 hours.

17. A process for producing a rare earth-iron-nitrogen permanent magnet as claimed in claim 14, wherein compression molding of the powder is performed by applying a molding pressure in the range of from 1 to 8 ton/cm$^2$.

18. A process for producing a rare earth-iron-nitrogen permanent magnet as claimed in claim 14, wherein a capsule made from soft steel or stainless steel or brass is used.

19. A process for producing a rare earth-iron-nitrogen permanent magnet as claimed in claim 14, wherein the shock wave in performing shock compression is generated by either collision method or direct method using explosives.

20. A process for producing a rare earth-iron-nitrogen permanent magnet as claimed in claim 14, wherein a powder of one element selected from the group of Al, Zn, In and Sn is further added as a binder.

* * * * *

UNITED STATES PATENT AND TRADEMARK OFFICE

CERTIFICATE OF CORRECTION

PATENT NO. : 5,425,818
DATED : June 20, 1995
INVENTOR(S) : Satoshi HIROSAWA et al.

It is certified that error appears in the above-indentified patent and that said Letters Patent is hereby corrected as shown below:

On the title page:

[73] Assignee: Sumitomo Special Metals Co., Ltd., Osaka; Tsutomu Mashimo, Kumamoto, both of Japan Signed and Sealed this Twelfth Day of December, 1995

*Attest:*

*Attesting Officer*

BRUCE LEHMAN

*Commissioner of Patents and Trademarks*